US005312295A

United States Patent [19]

Young

[11] Patent Number: 5,312,295

[45] Date of Patent: May 17, 1994

[54] SUBTERRANEAN TRANSFORMER ENCLOSURE VENT

[76] Inventor: James E. Young, 1265 Thiel Rd., Hayward, Calif. 94544

[21] Appl. No.: 110,732

[22] Filed: Aug. 23, 1993

[51] Int. Cl.[5] ..... F24F 7/00

[52] U.S. Cl. ..... 454/48; 454/275; 454/367

[58] Field of Search ..... 52/13, 473; 174/16.1, 174/17 VA, 39; 220/484; 404/2; 454/48, 184, 275, 280, 289, 367

[56] References Cited

U.S. PATENT DOCUMENTS

| | | | |
|---|---|---|---|
| 140,707 | 7/1873 | Hyatt | 454/275 X |
| 436,084 | 9/1890 | Jacobs | 454/48 |
| 809,617 | 1/1906 | Jackson | 454/48 X |
| 1,131,078 | 3/1915 | Pickles | 454/48 |
| 1,197,352 | 9/1916 | Darroch | 454/275 X |
| 1,199,664 | 9/1916 | Chambley | 454/257 |
| 4,880,594 | 11/1989 | Fui | 454/184 X |

*Primary Examiner*—Harold Joyce
*Attorney, Agent, or Firm*—Linval B. Castle

[57] ABSTRACT

A heat venting system for subterranean transformer enclosures for sidewalks or streets includes a vent guard that passes air but prevents solids and fluids such as destructive oil from dropping upon the transformers. Used in connection with a vent plate having very many small holes will prevent leaves and sticks from clogging the vent and destroying the transformers.

7 Claims, 2 Drawing Sheets

SUBTERRANEAN TRANSFORMER ENCLOSURE VENT

This invention relates to vents for subterranean enclosures or vaults and particularly to safety vents for the enclosures of underground electrical transformers.

BRIEF SUMMARY OF THE INVENTION

Large power distribution transformers generate a considerable amount of heat. In rural areas this may be dissipated by suspending the transformer on a utility pole or in an adequately fenced area, but in business districts the transformer must be placed in an underground enclosure and the heat dissipated by overhead vents at street or sidewalk level.

The vents used by utility companies are usually elongated slotted vents in large rectangular covers which are bolted to metal joists. These vents cover an enclosure containing transformers which generate heat which must be removed. One disadvantage of these vents is that the slots in the vents are wide to dissipate the heat but the width is dangerous because the wearer of high heels must use extreme caution in walking on the vent lest the heel will get caught and a leg broken.

Another disadvantage of the wide slots in the vents is that sticks, leaves and other trash items get stuck in the slots and block the venting thereby costing utility companies in street sweeping.

Transformers in subterranean enclosures are not damaged by water. But they are damaged by heat and oil. Many underground transformers have had to have been replaced because a clogged vent has greatly increased the heat and because people have discarded their waste drain oil through the chamber vent.

Briefly described the present invention is for a thin oil proof plastic vent guard that is placed under a vent having very many holes less that one quarter of an inch in diameter to eliminate danger to high heels. The vent guards are suspended between the metal joists used for suspending the vents and are "V" shaped with large air slots on the sides that have covering roofs to prevent liquids or solids from entering the vent from being passed to the transformer below.

The advantages of such a new venting system are many. Because the many holes in the vent are very small, valuables cannot readily drop through and it would be impossible for anyone to undertake the dangerous task of probing through the grating in search of anything. Also because of the small holes in the vent, there would be no claims of injury from a heel being stuck in the holes, and little chance of the holes being clogged with leaves or sticks which would normally brush off. The roofed vent guard will prevent water and oil from passing to a transformer but will vent off the heat. The water and oil that passes through the vent will be gathered in the apex of the "V" of the vent guard where is may be drained off through a drain plug.

BRIEF DESCRIPTION OF THE DRAWINGS

In the drawings which illustrate the preferred embodiment of the invention.

DETAILED DESCRIPTION

Subterranean transformer enclosures are usually large concrete chambers with thick, removable three by five foot metal plates containing vents placed on ceiling joists that are spaced about one foot apart. Depending upon the size of the enclosure, several of these vent plates may be used to dissipate the heat generated by transformers in the enclosure.

Figure 1:
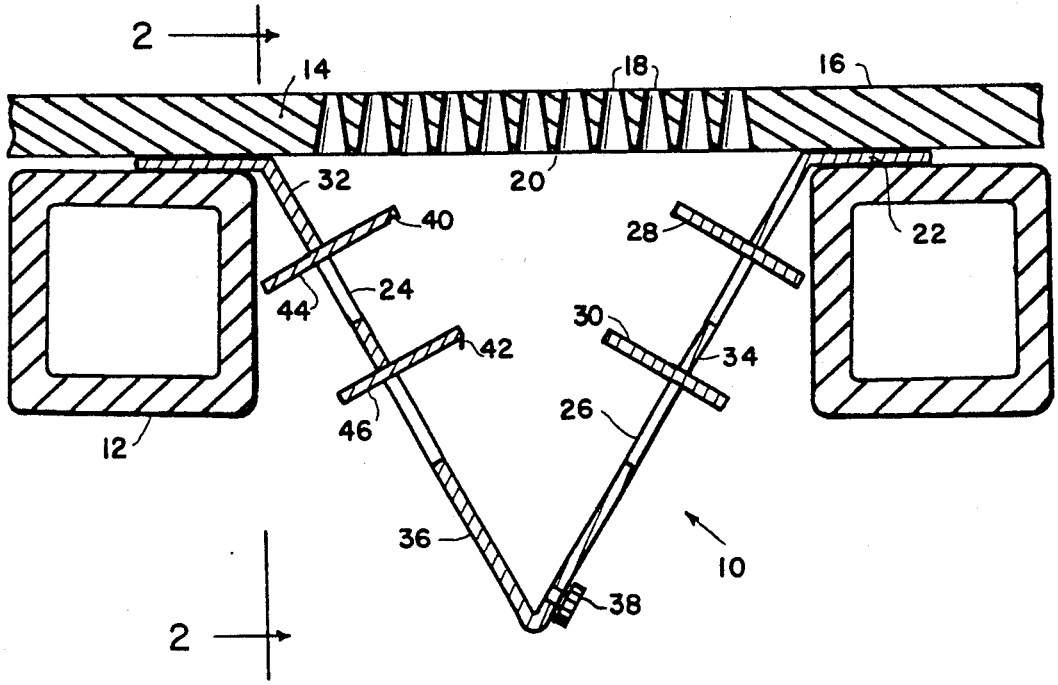
FIG. 1 is a sectional end view of a vent guard and a portion of an overlying vent.

Illustrated in FIG. 1 is a sectional elevational view of a vent guard 10 which is placed between adjacent joists 12 supporting a transformer enclosure ceiling and vent 14 the top surface 16 of which may be flush with a street of sidewalk surface. The vent may be cast with very many small vent holes 18 through the surface 16. Each hole is preferably tapered so that it is larger in diameter at the bottom surface 20 for ease in removing the vent from the casting. Also, the tapered holes assure that any debris that collects in the small holes will fall through the larger diameter below and will therefore clear the vent. The holes at the top surface 16 must be sufficiently small so that a small heel of a high heel woman's shoe cannot enter the hole.

Suspended between adjacent joists 12 and between the bottom surface 20 of the vent and the top surface of the adjacent joists is a vent guard 10. Its purpose is to prevent solids from dropping onto the transformers while providing venting of the hot air from the transformers.

The vent guard 10 is preferably formed of a non-conductive plastic with a "V" shaped cross section. The top edge of the "V" are horizontal sections 22 that clamp under the vent 14 and on half the top of a 4×4 inch joist 12. The remainder of the vent guard is formed as the "V" but with air slots 24, 26 formed in each side surface. Each slot is covered with an inclined roof; slot 24 is covered with roof 28 and slot 26 is covered with roof 30. Each roof is connected to the side wall of the "V" just above its slot and its outer edge extends out beyond the slot so that solids that collect between the roof and the surface of the "V above the slot will not enter a slot.

Thus, water or oil that may collect in the area formed by the wall portion 32 and the inclined roof 28 will not overflow into the slot 24 but will drop into the pool formed between the wall portion 34 and the roof 30. When the pool between portion 34 and the roof 30 if filled, it will not drop into the slot 26, but will drop into the apex 36 of the "V" where is may be drained off through a plug 38 which is screwed into one side near the lowest point of the "V".

The apex 36 of the "V" referred to is meant to denote that part of the guard 10 below the lower slots 26. It need not actually be a pointed and may be of any desired shape, such as rectangular or circular, and is only required as a sump which may be easily drained.

Each roof 28,30 provides cover for its respective slot 24,26 and to assure that overflowing liquids in the pools between the roofs and the walls do not run down the bottom surface of the roofs into the slots, each roof should have a drip edge which may in the form of a small groove 40 under the edge of roof 28 or a small depending edge of roof 42.

Each roof 28,30 extends into the interior of the vent guard 10 for covering a slot. The roofs also extend out past their respective slots and the exterior of the vent guard surface where they operate to deflect the hot transformer air and through the slots. Thus, the roof 28 over the slot 24 extends past the wall section 32 to become hot air deflector 44 and roof 30 over slot 26 extends out past the wall section 34 to become deflector 46

Figure 2:
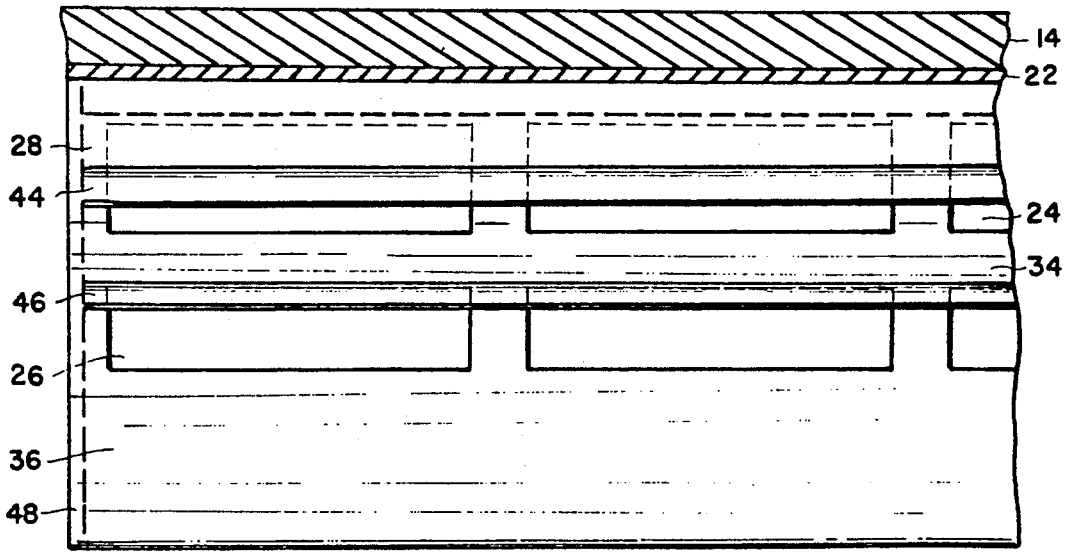
FIG. 2 is a side elevational view taken along the lines 2—2 of FIG. 1.

FIG. 2 is a side elevational view of a portion of the vent guard 10 taken along the lines 2—2 of FIG. 1 and illustrates a roof 28, shown by heavy dashed lines, covering the slots 24, shown in the interior of the guard, by light dashed lines. Each of the slots 24,26 has a total length of approximately five feet and is formed of several shorter slots, each separated by about one inch to provide strength, The roofs 28,30, however, must be continuous for the full length to prevent leakage into a slot. Each end of the vent guard is sealed with a cover 48 that prevents uncontrolled leakage from the ends of the pools formed between the roofs and their respective wall portions and also from the apex of the vent guard.

Figure 3:
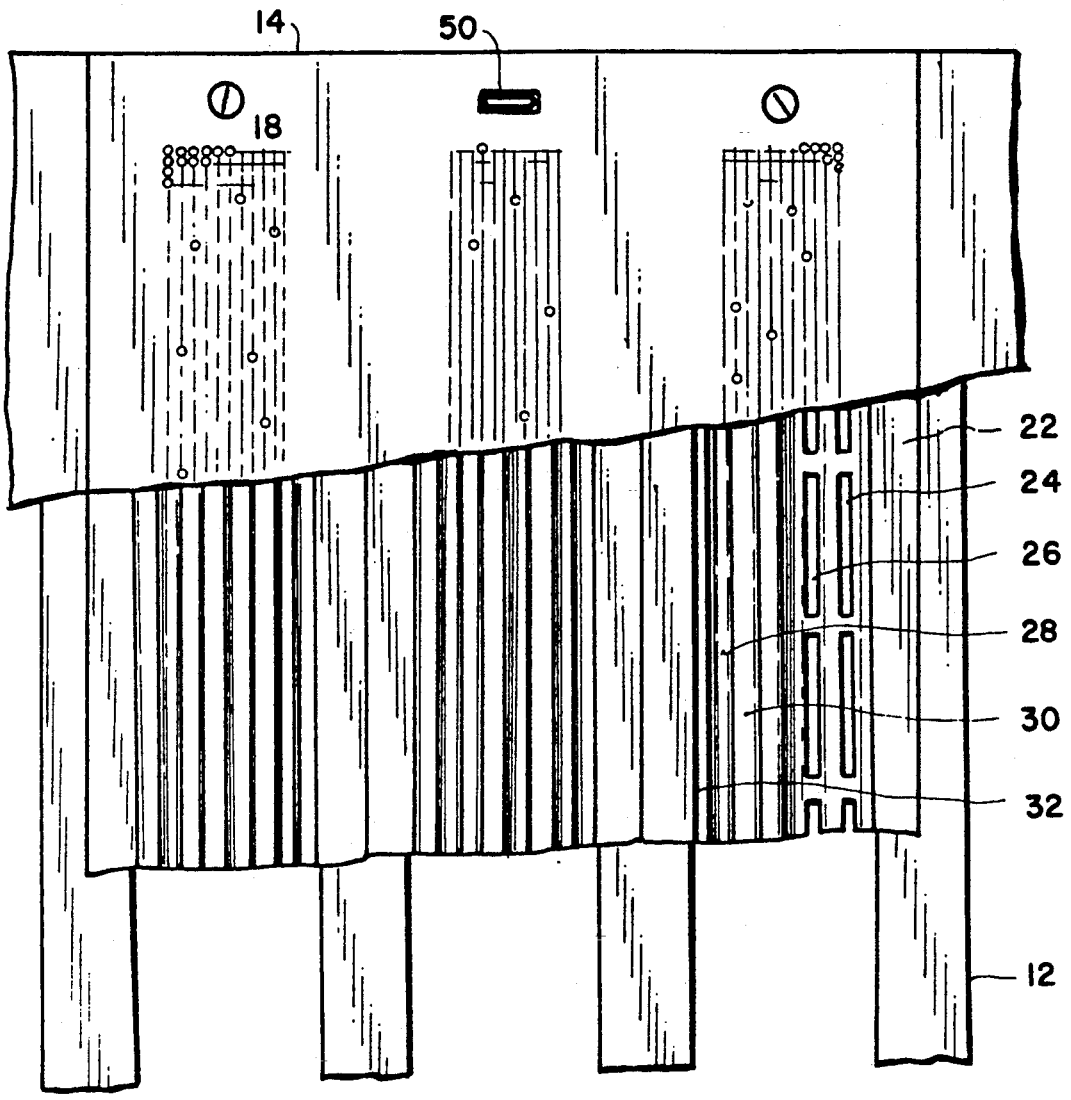
FIG. 3 is a plan view showing a vent, vent guards and joists.
Figure 4:
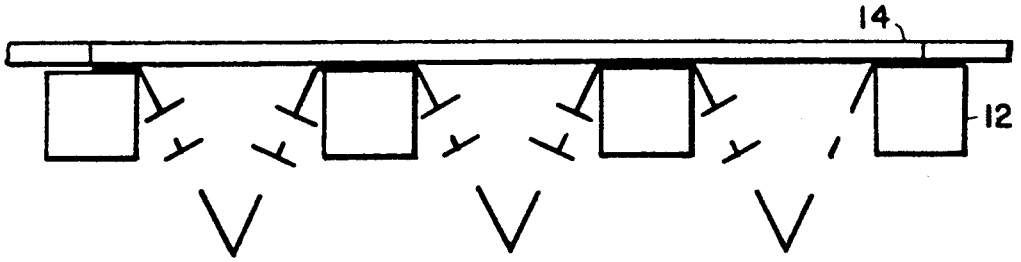
FIG. 4 is a simplified end view provided to assist in an understanding of FIG. 3.

FIG. 3 is a plan view illustrating the construction of one section of the ceiling of a subterranean transformer enclosure. In this figure the roofs have been omitted from one side of the right guard of the section to illustrate the slots 24, 26 therein. Each section is generally three by five feet and one large enclosure nay require several sections plus an additional section for access to the enclosure. Each section includes an iron vent 16 which may be three by five feet or smaller depending upon the dimensions of the enclosure. In accordance with the invention the vent contains many small vent holes 18, illustrated by dashed lines in FIG. 3, the holes being one quarter of an inch or less in diameter and covering the central area above each vent guard 10.

The vents 16 are supported by 4×4 inch joists 12 normally set on 12 inch centers as shown and between the joists and the vents are the vent guards 10, held in place by the weight of the heavy iron vent plates.

What is claimed is:

1. In a subterranean transformer enclosure having at least two ceiling joists for supporting a metal air vent plate, a vent guard for preventing liquids and solids from passing down through the guard and for enabling air to pass through the guard, said vent guard comprising:

a non-conductive structure having two side walls joined at an apex in a generally "V" cross sectional configuration with interior surfaces and exterior surfaces, said structure being suspendable from between the two ceiling joists;

at least one slot in said side walls above said apex and parallel therewith; and a roof within the interior of said structure and covering said slot, said roof being inclined to form a pool between said roof and a side wall of said structure, said roof extending over said slot so that liquids gathered in said pool will overflow into said apex;

said vent plate having a plurality of holes therethrough in an area over said vent guard.

2. The vent guard claimed in claim 1 further including means in a side wall adjacent said apex for draining liquids collected in said apex.

3. The vent guard claimed in claim 2 wherein said roof extends past said slot and exterior surface of said structure for deflecting hot air into said slot.

4. The vent guard claimed in claim 3 wherein said structure has two parallel slots and roofs and wherein the liquid gathered in a pool between the upper roof and a side wall will overflow into a pool formed between the lower roof and said side wall.

5. The vent guard claimed in claim 4 wherein the edge of each roof in the interior of said structure has a drip edge for preventing a flow down the inclined roofs.

6. The vent guard claimed in claim 4 wherein the top portions of said side walls of said vent guard is clamped between the joists and said overlying vent plate, each hole of said plurality having a maximum diameter of one quarter inch.

7. The vent guard claimed in claim 6 wherein said vent plate has a top surface and bottom surface and wherein the hole diameter in the top surface is a maximum of one quarter inch, said holes being tapered and said hole diameter being larger in said bottom surface.

* * * * *